US009514765B2

(12) United States Patent
Chao et al.

(10) Patent No.: US 9,514,765 B2
(45) Date of Patent: Dec. 6, 2016

(54) METHOD FOR REDUCING NOISE AND COMPUTER PROGRAM THEREOF AND ELECTRONIC DEVICE

(71) Applicant: Unlimiter MFA Co., Ltd., Eden Island, SC (US)

(72) Inventors: Kuan-Li Chao, Taipei (TW); Chih-Long Chang, Taipei (TW); Ju-Huei Tsai, Taipei (TW); Jing-Wei Li, Taipei (TW); Wei-Ming Chen, Taipei (TW); Neo Bob Chih-Yung Young, Taipei (TW); Kuo-Ping Yang, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 0 days.

(21) Appl. No.: 14/722,704

(22) Filed: May 27, 2015

(65) Prior Publication Data

US 2016/0133270 A1 May 12, 2016

(30) Foreign Application Priority Data

Nov. 12, 2014 (TW) ..... 103139189 A

(51) Int. Cl.
*G10L 21/0224* (2013.01)
*G10L 21/0264* (2013.01)

(52) U.S. Cl.
CPC ..... *G10L 21/0224* (2013.01); *G10L 21/0264* (2013.01)

(58) Field of Classification Search
CPC ..... G10L 21/0224; G10L 21/0264
See application file for complete search history.

(56) References Cited

U.S. PATENT DOCUMENTS

2009/0281800 A1* 11/2009 LeBlanc ..... G10L 21/0208 704/224
2011/0015923 A1* 1/2011 Dai ..... G10L 19/012 704/226
2013/0272543 A1* 10/2013 Tracey ..... H03G 3/32 381/107

* cited by examiner

*Primary Examiner* — Qian Yang
(74) *Attorney, Agent, or Firm* — Bacon & Thomas, PLLC

(57) ABSTRACT

A method for reducing noise is used to divide a received voice into plural voice segments and set a predetermined energy value. The energy of voice segment which is higher than the predetermined energy value is determined as normal voice and outputs directly, and the energy of voice segment which is lower than the predetermined energy value is determined as noise and will be processed.

18 Claims, 6 Drawing Sheets

| Voice segment | T0 | T1 | T2 | T3 | T4 | T5 | T6 | T7 | T8 | T9 | T10 | T11 | T12 | T13 | T14 | T15 |
|---|---|---|---|---|---|---|---|---|---|---|---|---|---|---|---|---|
| Ratio before correction R= Maximum energy value A/ Predetermined energy value | R0 | R1 | R2 | R3 | R4 | R5 | R6 | R7 | R8 | R9 | R10 | R11 | R12 | R13 | R14 | R15 |
| | >1 | >1 | >1 | >1 | >1 | 0.6 | 0.7 | 0.6 | 0.8 | 0.8 | >1 | >1 | >1 | >1 | >1 | >1 |
| Corrected ratio R' | **1** | **1** | **1** | **1** | **1** | **0.9** | **0.8** | **0.7** | **0.8** | **0.8** | **0.9** | **1** | **1** | **1** | **1** | **1** |

FIG. 4

| Voice segment | T0 | T1 | T2 | T3 | T4 | T5 | T6 | T7 | T8 | T9 | T10 | T11 | T12 | T13 | T14 | T15 |
|---|---|---|---|---|---|---|---|---|---|---|---|---|---|---|---|---|
| Ratio before correction R= Maximum energy value A/ Predetermined energy value | R0 | R1 | R2 | R3 | R4 | R5 | R6 | R7 | R8 | R9 | R10 | R11 | R12 | R13 | R14 | R15 |
| | >1 | >1 | >1 | >1 | >1 | >1 | 0.7 | 0.7 | 0.8 | 0.8 | >1 | >1 | >1 | >1 | >1 | >1 |
| Corrected ratio R' | **1** | **1** | **1** | **1** | **1** | **1** | **0.9** | **0.8** | **0.8** | **0.8** | **0.9** | **1** | **1** | **1** | **1** | **1** |

FIG. 5

| Voice segment | | | | T4 | T5 | T6 | T7 | T8 | T9 | T10 | T11 | | | | |
|---|---|---|---|---|---|---|---|---|---|---|---|---|---|---|---|
| Ratio before correction R= Maximum energy value A/ Predetermined energy value | | | ... | R4 | R5 | R6 | R7 | R8 | R9 | R10 | R11 | | ... | | |
| | | | | >1 | 0.6 | 0.7 | 0.6 | 0.8 | 0.8 | >1 | >1 | | | | |
| Corrected ratio R' | | | | **1** | **0.95** | **0.9** | **0.85** | **0.8** | **0.8** | **0.9** | **1** | | | | |

FIG. 6

METHOD FOR REDUCING NOISE AND COMPUTER PROGRAM THEREOF AND ELECTRONIC DEVICE

BACKGROUND OF THE INVENTION

1. Field of the Invention

The present invention relates to a method for reducing noise; more particularly, the present invention relates to a method capable of controlling a noise adjustment ratio during a noise reduction process.

2. Description of the Related Art

There are various ways of reducing noise, and the known technique related to amplitude adjustment has been disclosed in publications such as Taiwan Patent No. M277217 issued on Oct. 1, 2005 entitled "Background noise elimination device", which comprises an amplitude capture channel to insulate low voltage signals, because in its disclosure, the low voltage signals are determined as noise signals. Therefore, after the low voltage signals are insulated, high voltage signals (which are normal voice) successfully passing through the channel for being played are the voice without noise interference. However, the insulated low voltage signals might possibly contain non-noise voice, if they are determined as noise and directly insulated, the output voice would be different from the original voice and sounds unnatural, therefore it is necessary to improve the method of reducing noise by simply adjusting the amplitude.

Therefore, there is a need to provide a method for reducing noise and a computer program thereof and an electronic device to mitigate and/or obviate the aforementioned problems.

SUMMARY OF THE INVENTION

It is an object of the present invention to provide a method for reducing noise.

To achieve the abovementioned object, the method for reducing noise of the present invention comprises: dividing an input voice into a plurality of voice segments; and obtaining a maximum energy reference value of a current voice segment.

The energy of the current voice segment is adjusted according to a current reference ratio, wherein the current reference ratio is calculated according to the maximum energy reference value and a predetermined energy value, and the current reference ratio is less than or equal to 1 and greater than or equal to 0.

According to one embodiment of the present invention, the maximum energy reference value is determined according to the maximum energy from n voice segments prior to the current voice segment, wherein n is between 0 and 180 (depending on the number of sampling points included in each voice segment and a system sampling rate; as an assumption of covering two wave crests (or two wave troughs) of 70 Hz, n is 9 if the sampling rate is 44100 Hz and each voice segment has 64 sampling points; and n is 171 if the sampling rate is 192000 Hz and each voice segment has 16 sampling points); if n is 0, the maximum energy reference value is the maximum energy of the current voice segment.

According to one embodiment of the present invention, the current reference ratio is calculated further according to a previous reference ratio, where the previous reference ratio is an energy used for adjusting a previous voice segment. The previous reference ratio is less than or equal to 1 and greater than or equal to 0, and the previous voice segment is one voice segment ahead of the current voice segment.

According to one embodiment of the present invention, the current reference ratio is calculated further according to a constraint coefficient, and the constraint coefficient is less than 1 and greater than 0. The constraint coefficient can be different when the voice energy increases and decreases. For example, when the voice energy increases (with the current reference ratio greater than the previous reference ratio), the constraint coefficient is between 0.01 and 1; and, when the voice energy decreases (with the current reference ratio less than the previous reference ratio), the constraint coefficient is between 0.0004 and 0.1. Because when the voice energy increases, there is no need to restrict the change of the reference ratio too much (so as to normally output normal voice as soon as possible (by setting the reference ratio as 1), and therefore the constraint coefficient is larger); when the voice energy decreases, it is easy to mistakenly determine the ending sound (with a smaller amplitude) of the normal voice as noise for adjustment, and therefore in order to avoid over-adjustment to mute the ending sound, the reference ratio adjustment would be slower which results in a smaller constraint coefficient.

According to one embodiment of the present invention, the energy of the maximum energy reference value and the predetermined energy value is a sound amplitude.

According to one embodiment of the present invention, the predetermined energy value is between 30 dB and 90 dB.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views:

FIG. 4 is a table showing ratios of a plurality of voice segments according to one embodiment of the present invention.

FIG. 5 is a table showing ratios of a plurality of voice segments according to another embodiment of the present invention.

FIG. 6 is a table showing ratios of a plurality of voice segments according to yet another embodiment of the present invention.

DETAILED DESCRIPTION OF THE PREFERRED EMBODIMENT

Figure 1:
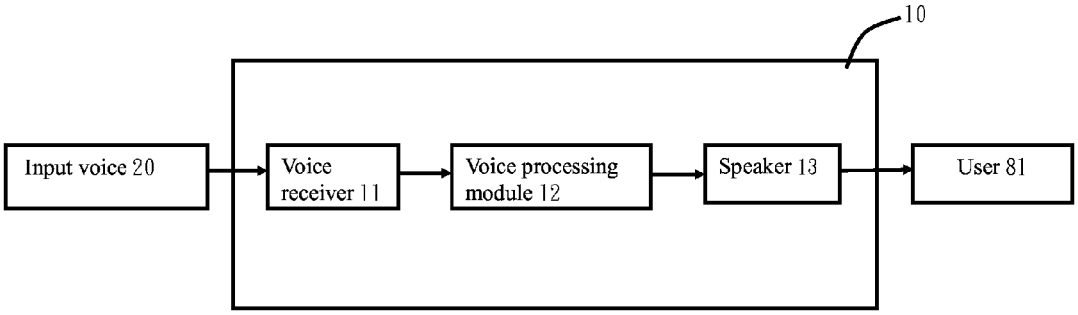
FIG. 1 illustrates a structural drawing of a hearing aid according to the present invention.

Please refer to FIG. 1, which illustrates a structural drawing of a hearing aid according to the present invention.

A voice electronic device 10 of the present invention comprises a voice receiver 11, a voice processing module 12 and a speaker 13. The voice receiver 11 is used for receiving an input voice 20. And the input voice 20 is processed by the voice processing module 12 for being outputted by the speaker 13 to a user 81. The voice receiver 11 can be a microphone or any other equivalent voice receiving equipment; and the speaker 13 (which can also include an amplifier) can be a headphone or any other equivalent voice outputting equipment without being limited to the above scope. The voice processing module 12 is generally composed of a sound effect processing chip associated with a control circuit and an amplification circuit; or can be composed of a solution including a processor and a memory associated with a control circuit and an amplification circuit. The purpose of the voice processing module 12 is to carry out amplification to voice signals, to filter out noises, to change voice frequency composition, and to carry out necessary processes to achieve the object of the present invention. Because the voice processing module 12 can be implemented by utilizing conventional hardware associated with new firmware or software, there is no need for further description about the hardware structure of the voice processing module 12. The voice electronic device 10 of the present invention can be a hardware specialized dedicated device, or can be, but not limited to, a small computer such as a personal digital assistant (PDA), a mobile phone, a hearing-aid headphone (such as a Bluetooth headphone having a chip or a processor for processing audio signals), a smart phone and/or a personal computer installed with a software program. The voice electronic device 10 of the present invention can be designed for a hearing-impaired listener, therefore, the voice processing module 12 can process functions such as frequency conversion, frequency compression or frequency shifting. However, because the purpose of the present invention is not focused on frequency processing, there is no need for further description.

Figure 2:
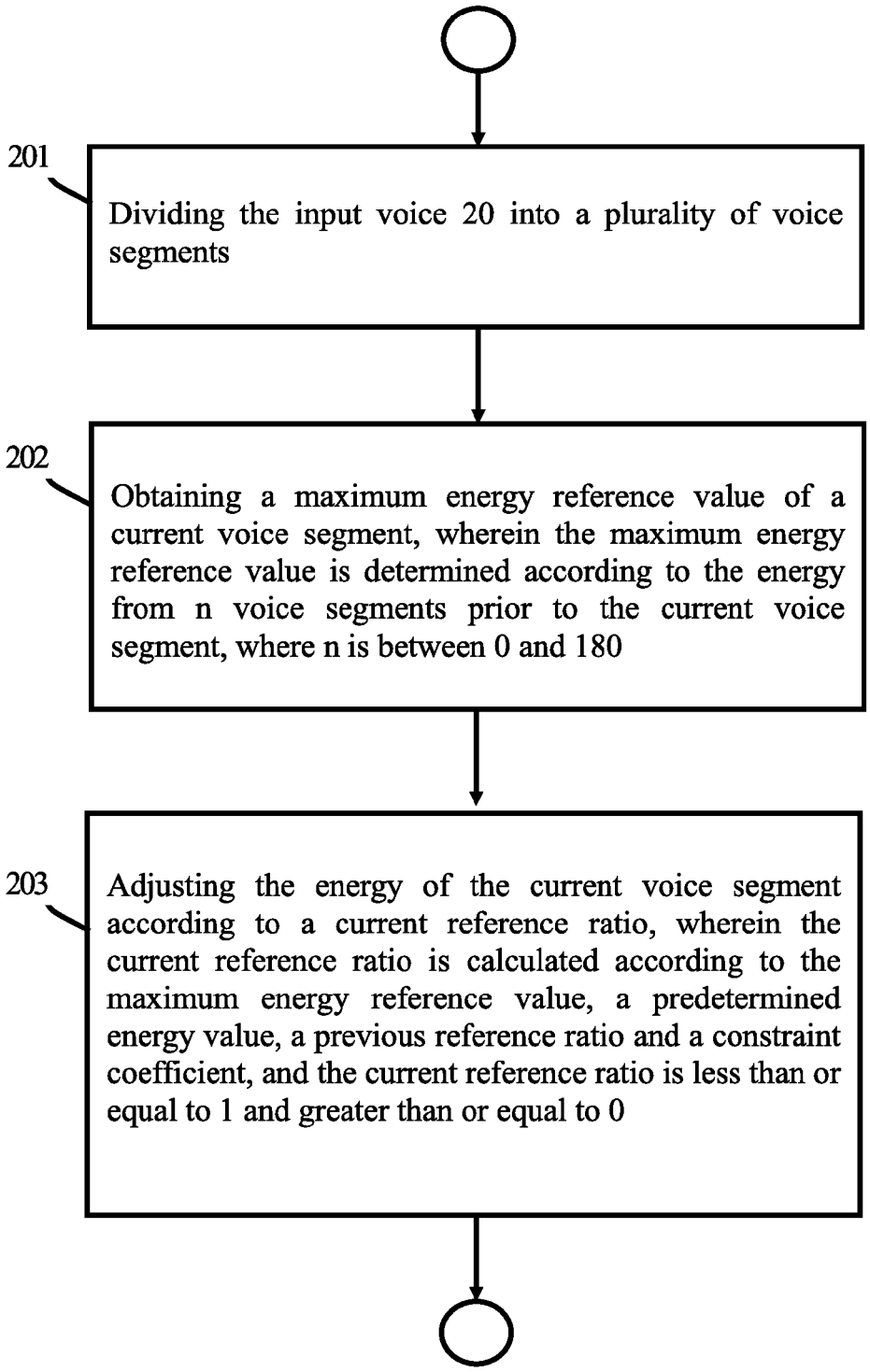
FIG. 2 illustrates a flowchart of a voice processing module according to the present invention.

Then, please refer to FIG. 2, which illustrates a flowchart of the voice processing module according to the present invention. Please also refer to FIG. 3 and FIG. 4 for more details of the present invention.

The object of the present invention is to reduce the influence caused by noise energy to the overall voice energy. According to the embodiment, the definition of energy is sound amplitude. The method for determining noise is to set a predetermined energy value as a reference value, such as 40 dB, wherein the voice over 40 dB is determined as normal voice, and the voice lower than 40 dB is determined as noise. The voice determined as noise would multiply by a certain ratio to reduce its energy in order to reduce the noise influence. According to a preferred embodiment of the present invention, the predetermined energy value is between 30 dB and 90 dB. The reason of setting the predetermined energy value as high as even 90 dB is because there might be a scenario of a user using the device bundled with this method for reducing noise while taking public transportation, and in this case, the predetermined energy value would not be set as only 30 dB, instead the predetermined energy value would be set higher, such as 80 dB, so as to process louder noise.

Step 201: dividing the input voice 20 into a plurality of voice segments 21.

The time length of each voice segment is preferably between 0.0000833 and 0.1 second (e.g. it is suggested to be 0.0000833 second if the sampling rate is 192000 Hz and each voice segment has 16 sampling points). According to an experiment which utilizes an Apple iPhone4 as the hearing aid (by means of executing, in the Apple iPhone4, a software program made according to the present invention), a positive outcome is obtained when the time length of each voice segment is between about 0.0001 and 0.1 second, which means 10~10,000 voice segments in each second. For the convenience of explanation, 15 voice segments are displayed in the embodiment.

Step 202: obtaining a maximum energy reference value of a current voice segment, wherein the maximum energy reference value is determined according to the energy from n voice segments prior to the current voice segment, where n is between 0 and 180. Basically, n can be larger if the time length of each voice segment is smaller.

Figure 3:
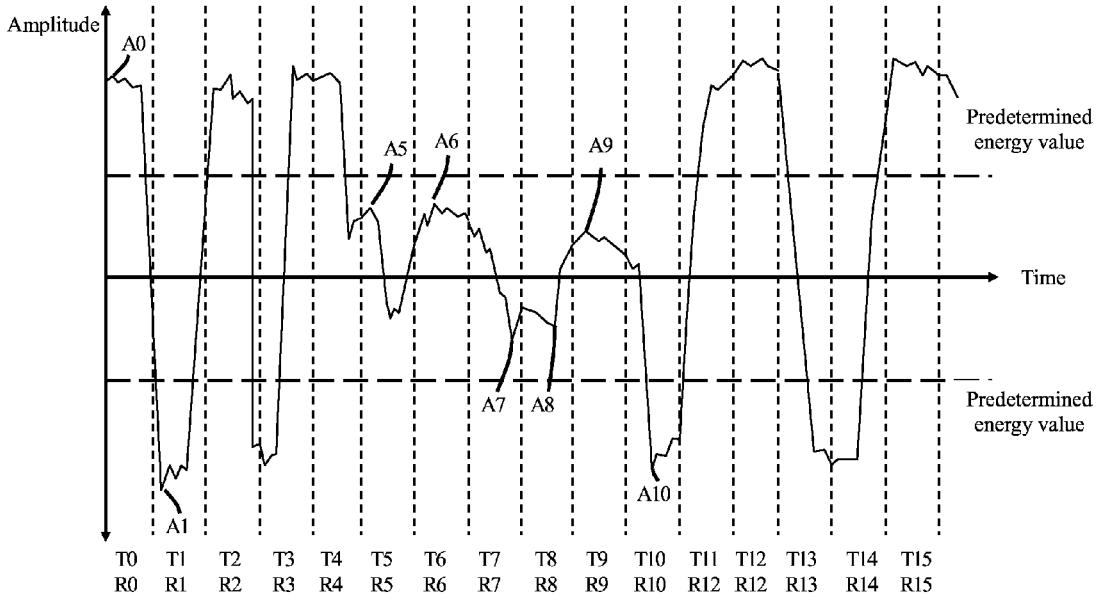
FIG. 3 illustrates a schematic drawing of dividing an input voice into a plurality of voice segments.

The maximum energy reference value is the value of the maximum amplitude among the voice segments. As shown in FIG. 3, for example, A0, A1, A5, A6, A7, A8, A9 and A10 are respectively the maximum energy values of the voice segments T0, T1, T5, T6, T7, T8, T9 and T10. In this embodiment, the method of finding the maximum energy value is to find out the maximum "amplitude" of a certain voice segment. As a result, the predetermined energy value is a predetermined "amplitude" value. n represents the number of the reference voice segments. If n is 0, the voice processing module 12 uses the maximum energy of the current voice segment as the maximum energy reference value; and if n is 3, the voice processing module 12 uses the maximum energy from 3 voice segments prior to the current voice segment as the maximum energy reference value. The method of sampling the maximum energy reference value will be described in more details hereinafter.

Step 203: adjusting the energy of the current voice segment according to a current reference ratio, wherein the current reference ratio is calculated according to the maximum energy reference value, a predetermined energy value, a previous reference ratio and a constraint coefficient, and the current reference ratio is less than or equal to 1 and greater than or equal to 0.

After the maximum energy reference value is found, the voice processing module 12 would divide the "maximum energy reference value" by the "predetermined energy value" to obtain a current reference ratio. If the maximum energy reference value is greater than or equal to the predetermined energy value, the current reference ratio is greater than or equal to 1, it means the voice segment having the maximum energy reference value is a normal voice, and thus the current reference ratio would be corrected as 1. Please note that the current reference ratio might need further correction by taking the previous reference ratio and the constraint coefficient into account. If the maximum energy reference value is less than the predetermined energy value, the voice processing module 12 would determine the current voice segment as noise and process the current reference ratio.

The method of processing the noise is to multiply the "current voice segment energy" by the "ratio after correction" to be used as the current voice segment energy. However, in order to prevent the voice processing module 12 from over-processing the noise voice segment to produce unnatural voice, the present invention further comprises a constraint coefficient, which is used for restricting the correction range of the reference ratio. For the convenience of explaining the functions of the constraint coefficient applied for adjusting the reference ratio and n applied for correcting the reference ratio, in FIG. 4 and FIG. 5, the constraint coefficient is set as 0.1; however, please note that the constraint coefficient is different (as shown in FIG. 6) when the voice energy increases and decreases according to practical experimental results. For example, when the voice energy increases (which means the current reference ratio is greater than the previous reference ratio), the constraint coefficient is between 0.01 and 1; when the voice energy decreases (which means the current reference ratio is less than the previous reference ratio), the constraint coefficient is between 0.0004 and 0.1. Because when the voice energy increases, there is no need to restrict the change of the reference ratio too much (so as to output normal voice as soon as possible (by setting the reference ratio as 1), and therefore the constraint coefficient is larger); when the voice energy decreases, it is easy to mistakenly determine the ending sound (with a smaller amplitude) of the normal voice as noise for adjustment, and therefore in order to avoid over-adjustment to mute the ending sound, the reference ratio adjustment would be slower which results in a smaller constraint coefficient. Basically, the constraint coefficient under the condition that the voice energy decreases would be smaller than the constraint coefficient under the condition that the voice energy increases. The value of the constraint coefficient is fundamentally related to the length of the voice segment. The shorter the time length of the voice segment is, the smaller the constraint coefficient could be. The constraint coefficient can also be related to other voice characteristics. For example, the constraint coefficient can be corrected by referring to more than one constraint equation; or, the voice segments with ratio values between 0.5 and 1 can be set closer to 1 to avoid over-process. As a result, the constraint coefficient is not necessarily a fixed value.

To understand the above methods and the use of the constraint coefficient, please refer to FIG. 2~5 including two embodiments for describing the calculations of R1~R15 step by step.

As shown in FIG. 4, which is a calculation table according to one embodiment of the present invention, after the input voice 20 has been divided into a plurality of voice segments, the method performs sampling to the maximum energy reference value. If n is 0, the voice processing module 12 only samples the maximum energy of the current voice segment as the maximum energy reference value of the voice segment. For example, if the current voice segment for current determination is the voice segment T0, then the amplitude A0 is the maximum energy reference value of the voice segment T0. Calculated according to A0, the current reference ratio (which is calculated by dividing the maximum energy reference value by the predetermined energy value) is greater than 1, and is determined as a normal voice, therefore the current reference ratio R0' would be corrected as 1. Similarly, the current reference ratios R1'~R4' of the voice segments T1~T4 are all corrected as 1.

The current reference ratio R5 of the voice segment T5 is calculated as 0.6 (by dividing the energy of A5 by the predetermined energy value), and it has to be corrected according to the constraint coefficient and the previous current reference ratio R4'. Because R5 is less than R4', the corrected R5' (1−0.1=0.9) is calculated by deducting one unit of the constraint coefficient from R4'.

The current reference ratio R6 of the voice segment T6 is calculated as 0.7, and it has to be corrected according to the constraint coefficient and the previous current reference ratio R5'. Because R6 is less than R5', the corrected R6' (0.9−0.1=0.8) is calculated by deducting one unit of the constraint coefficient from R5'. According to the above description, there is no need for further describing the voice segment T7, wherein its corrected R7' is calculated as 0.7.

The current reference ratio R8 of the voice segment T8 is calculated as 0.8, and it has to be corrected according to the constraint coefficient and the previous current reference ratio R7'. Because R8 is greater than R7', the corrected R8' (0.7+0.1=0.8) is calculated by adding one unit of the constraint coefficient to R7'.

The current reference ratio R9 of the voice segment T9 is calculated as 0.8, and it has to be corrected according to the constraint coefficient and the previous current reference ratio R8'. However, since R9 is equal to R8', there is no need for correction.

The current reference ratio R10 of the voice segment T10 is calculated as greater than 1, and it has to be corrected according to the constraint coefficient and the previous current reference ratio R9'. Because R10 is greater than R9', the corrected R10' (0.8+0.1=0.9) is calculated by adding one unit of the constraint coefficient to R9'.

The current reference ratio R10 of the voice segment T11 is calculated as greater than 1, and it has to be corrected according to the constraint coefficient and the previous current reference ratio R10'. Because R11 is greater than R10', the corrected R11' (0.9+0.1=1) is calculated by adding one unit of the constraint coefficient to R10'.

The rules of correcting the voice segments T12~T15 are identical to the rules of correcting the voice segments T0~T4, there is no need for further description.

In short, the ratio calculated for each voice segment is just a reference value for comparison. By comparing the ratio of the previous voice segment with the ratio of the current voice segment, and performing addition and/or deduction through the constraint coefficient, then the final ratio being through addition/deduction can be used as the ratio for reducing the voice energy.

As shown in FIG. 5, which is a calculation table according to another embodiment of the present invention, please also refer to FIG. 3 for better understanding this embodiment. For example, if n is 1, the voice processing module 12 would use the maximum energy from the current voice segment and its previous voice segments as the maximum energy reference value of the current voice segment. For example, if the current voice segment for current determination is the voice segment T1, and the amplitude A0 is greater than A1, then A0, instead of A1, is the maximum energy reference value of the voice segment T1. Calculated according to A0, the current reference ratio (which is calculated by dividing the maximum energy reference value by the predetermined energy value) is greater than 1, and is determined as a normal voice, therefore the current reference ratio R1' would be corrected as 1. Likewise, the current reference ratios R2'~R4' of the voice segments T2~T4 are all corrected as 1.

According to the above rules, the maximum energy reference value adopted by T5 should be the maximum energy of T4, therefore the current reference ratio R5 (which is calculated by dividing A4 by the predetermined energy value) is greater than 1, and thus the current reference ratio R5' would be corrected as 1.

The maximum energy reference value adopted by T6 should be the maximum energy of T6 (because A6>A5), therefore the current reference ratio R6 is 0.7, and it has to be corrected according to the constraint coefficient and the previous current reference ratio R5'. Because R6 is less than R5', the corrected R6' (1−0.1=0.9) is calculated by deducting one unit of the constraint coefficient from R5'.

The maximum energy reference value adopted by T7 should be the maximum energy of T6 (because A7<A6), therefore the current reference ratio R7 is 0.7, and it has to be corrected according to the constraint coefficient and the previous current reference ratio R6'. Because R7 is less than R6', the corrected R7' (0.9−0.1=0.8) is calculated by deducting one unit of the constraint coefficient from R6'.

The maximum energy reference value adopted by T8 should be the maximum energy of T8 (because A8>A7), therefore the current reference ratio R8 is 0.8, and it has to be corrected according to the constraint coefficient and the previous current reference ratio R7'. However, since R8 is equal to R7', there is no need for correction.

The maximum energy reference value adopted by T9 can be the maximum energy of either T8 or T9 (because A9=A8), therefore the current reference ratio R9 is 0.8, and it has to be corrected according to the constraint coefficient and the previous current reference ratio R8'. However, since R9 is equal to R8', there is no need for correction.

The maximum energy reference value adopted by T10 should be the maximum energy of T10 (because A10>A9), therefore the current reference ratio R10 is 0.8, and it has to be corrected according to the constraint coefficient and the previous current reference ratio R9'. Because R10 is greater than R9', the corrected R10' (0.8+0.1=0.9) is calculated by adding one unit of the constraint coefficient to R9'.

The maximum energy reference value adopted by T11 can be the maximum energy of either T10 or T11 (because both A11 and A10 are greater than 1), therefore the current reference ratio R11 is greater than 1, and it has to be corrected according to the constraint coefficient and the previous current reference ratio R10'. Because R11 is greater than R10', the corrected R11' (0.9+0.1=1) is calculated by adding one unit of the constraint coefficient to R10'.

The rules of correcting the voice segments T12~T15 are identical to the rules of correcting the voice segments T0~T5, there is no need for further description.

Please note that, the initial value of the reference ratio of the voice is predetermined as 1. Therefore, in the above two embodiments, if the voice begins with noise (with A0 less than the predetermined energy value, and R0<1), the corrected ratio R0' (1−(constraint coefficient)=R0') would be calculated by deducting one unit of the constraint coefficient from 1 according to the constraint coefficient and the previous current reference ratio.

Please refer to FIG. 6, which is a table showing ratios of a plurality of voice segments according to yet another embodiment of the present invention. Also set n=0 as an example, the voice processing module 12 would only sample the maximum energy of the current voice segment as the maximum energy reference value of its voice segment. Moreover, the constraint coefficient in this embodiment would be different when the voice energy increases or decreases.

T4 to T8 shows the change when the voice energy decreases, wherein the constraint coefficient is between 0.0004 and 0.1 when it decreases. In this embodiment, the constraint coefficient is set as 0.05.

The current reference ratio R5 of the voice segment T5 is calculated as 0.6, and it has to be corrected according to the constraint coefficient and the previous current reference ratio R4'. Because R5 is less than R4', the corrected R5' (1−0.05=0.95) is calculated by deducting one unit of the constraint coefficient from R4'. Same calculation rules apply to T6 to T8.

T9 to T11 shows the change when the voice energy increases, wherein the constraint coefficient is between 0.01 and 1 when it increases. In this embodiment, the constraint coefficient is set as 0.1.

The current reference ratio R10 of the voice segment T10 is calculated as greater than 1, and it has to be corrected according to the constraint coefficient and the previous current reference ratio R9'. Because R10 is greater than R9', the corrected R10' (0.8+0.1=0.9) is calculated by adding one unit of the constraint coefficient to R9'. The same calculation rule is also applied to T11.

If the number of voice segments n for selecting the maximum energy changes, the corrected ratio would be different, and the amplitude of voice adjustment would be different accordingly. For the convenience of explanation, n is set as 0 and 1 only as examples. However, according to preferred embodiments, if the sampling rate is 44100 Hz and each voice segment has 64 sapling points, n would be set as 7~10 to better achieve the desired noise reduction purpose. The purpose of having higher number n of the sampling voice segments is because: the amplitude of the voice itself is in a curve shape, some voice segments located in the predetermined energy values are in fact just transitions of the curve instead of noise, therefore fewer samples would easily cause misjudgement.

Please note that the method for reducing noise of the present invention is not only applicable for realtime hearing aid processing, but also can be applicable for a non-realtime voice processing device, such as removing noise from a pre-recorded voice. Although the present invention has been explained in relation to its preferred embodiments, it is to be understood that many other possible modifications and variations can be made without departing from the spirit and scope of the invention as hereinafter claimed.

What is claimed is:

1. A method for reducing noise, applied in a voice electronic device, the voice electronic device receiving an input voice, and the method comprising:

dividing the input voice into a plurality of voice segments;

obtaining a maximum energy reference value of a current voice segment; and adjusting the energy of the current voice segment according to a current reference ratio, wherein the current reference ratio is calculated according to the maximum energy reference value and a predetermined energy value, and the current reference ratio is less than or equal to 1 and greater than or equal to 0, wherein the maximum energy reference value is determined according to the maximum energy from n voice segments prior to the current voice segment, where n is between 0 and 180, and if n is 0, the maximum energy reference value is the maximum energy of the current voice segment, wherein the current reference ratio is calculated further according to a previous reference ratio, where the previous reference ratio is an energy used for adjusting a previous voice segment, the previous reference ratio is less than or equal to 1 and greater than or equal to 0, and the previous voice segment is one voice segment ahead of the current voice segment, and wherein the current reference ratio is calculated further according to a constraint coefficient, and if the current reference ratio is greater than the previous reference ratio, the constraint coefficient is between 0.01 and 1.

2. The method for reducing noise as claimed in claim 1, wherein the energy of the maximum energy reference value and the predetermined energy value are defined as sound amplitude.

3. The method for reducing noise as claimed in claim 2, wherein the predetermined energy value is between 30 dB and 90 dB.

4. The method for reducing noise of claim 1, further comprising the step of outputting the adjusted voice segment.

5. A method for reducing noise, applied in a voice electronic device, the voice electronic device receiving an input voice, and the method comprising:

dividing the input voice into a plurality of voice segments;

obtaining a maximum energy reference value of a current voice segment; and adjusting the energy of the current voice segment according to a current reference ratio, wherein the current reference ratio is calculated according to the maximum energy reference value and a predetermined energy value, and the current reference ratio is less than or equal to 1 and greater than or equal to 0, wherein the maximum energy reference value is determined according to the maximum energy from n voice segments prior to the current voice segment, where n is between 0 and 180, and if n is 0, the maximum energy reference value is the maximum energy of the current voice segment, wherein the current reference ratio is calculated further according to a previous reference ratio, where the previous reference ratio is an energy used for adjusting a previous voice segment, the previous reference ratio is less than or equal to 1 and greater than or equal to 0, and the previous voice segment is one voice segment ahead of the current voice segment, and wherein the current reference ratio is calculated further according to a constraint coefficient, and if the current reference ratio is less than the previous reference ratio, the constraint coefficient is between 0.0004 and 0.1.

6. The method for reducing noise as claimed in claim 5, wherein the energy of the maximum energy reference value and the predetermined energy value are defined as sound amplitude.

7. The method for reducing noise as claimed in claim 6, wherein the predetermined energy value is between 30 dB and 90 dB.

8. A method for reducing noise, applied in a voice electronic device, the voice electronic device receiving an input voice, and the method comprising:

dividing the input voice into a plurality of voice segments;

obtaining a maximum energy reference value of a current voice segment; and adjusting the energy of the current voice segment according to a current reference ratio, wherein the current reference ratio is calculated according to the maximum energy reference value and a predetermined energy value, and the current reference ratio is less than or equal to 1 and greater than or equal to 0, wherein the maximum energy reference value is determined according to the maximum energy from n voice segments prior to the current voice segment, where n is between 0 and 180, and if n is 0, the maximum energy reference value is the maximum energy of the current voice segment, wherein the current reference ratio is calculated further according to a previous reference ratio, where the previous reference ratio is an energy used for adjusting a previous voice segment, the previous reference ratio is less than or equal to 1 and greater than or equal to 0, and the previous voice segment is one voice segment ahead of the current voice segment, and wherein the current reference ratio is calculated further according to a constraint coefficient, and if the current reference ratio is greater than the previous reference ratio, the constraint coefficient with the current reference ratio greater than the previous reference ratio is greater than the constraint coefficient with the current reference ratio less than the previous reference ratio.

9. The method for reducing noise as claimed in claim 8, wherein the energy of the maximum energy reference value and the predetermined energy value are defined as sound amplitude.

10. The method for reducing noise as claimed in claim 9, wherein the predetermined energy value is between 30 dB and 90 dB.

11. An electronic device for reducing noise, comprising a voice receiver, a voice processing module and a speaker, wherein the voice receiver and the speaker are electrically connected to the voice processing module, and the voice processing module is used for implementing the method as claimed in claim 1.

12. The electronic device for reducing noise as claimed in claim 11, wherein the energy of the maximum energy reference value and the predetermined energy value are defined as sound amplitude.

13. The electronic device for reducing noise as claimed in claim 12, wherein the predetermined energy value is between 30 dB and 90 dB.

14. An electronic device for reducing noise, comprising a voice receiver, a voice processing module and a speaker, wherein the voice receiver and the speaker are electrically connected to the voice processing module, and the voice processing module is used for implementing the method as claimed in claim 5.

15. The electronic device for reducing noise as claimed in claim 14, wherein the energy of the maximum energy reference value and the predetermined energy value are defined as sound amplitude.

16. An electronic device for reducing noise, comprising a voice receiver, a voice processing module and a speaker, wherein the voice receiver and the speaker are electrically connected to the voice processing module, and the voice processing module is used for implementing the method as claimed in claim 8.

17. The electronic device for reducing noise as claimed in claim 16, wherein the energy of the maximum energy reference value and the predetermined energy value are defined as sound amplitude.

18. The electronic device for reducing noise as claimed in claim 17, wherein the predetermined energy value is between 30 dB and 90 dB.

* * * * *